US011412787B1

(12) United States Patent
Galustyants

(10) Patent No.: US 11,412,787 B1
(45) Date of Patent: Aug. 16, 2022

(54) HOODIE MASK

(71) Applicant: Avanes Galustyants, Shrub Oak, NY (US)

(72) Inventor: Avanes Galustyants, Shrub Oak, NY (US)

( * ) Notice: Subject to any disclaimer, the term of this patent is extended or adjusted under 35 U.S.C. 154(b) by 0 days.

(21) Appl. No.: 17/239,502

(22) Filed: Apr. 23, 2021

(51) Int. Cl.
*A41D 1/04* (2006.01)
*A41D 13/11* (2006.01)

(52) U.S. Cl.
CPC ..... *A41D 1/04* (2013.01); *A41D 13/1153* (2013.01); *A41D 2200/20* (2013.01)

(58) Field of Classification Search
CPC ..... A41D 2200/20; A41D 13/1153; A41D 3/005; A62B 17/04; A42B 1/006; A42B 1/046; A42B 1/048; A42B 1/225; A42B 1/206
USPC ..... D2/831
See application file for complete search history.

(56) References Cited

U.S. PATENT DOCUMENTS 768,626 A * 8/1904 Rautenberg ..... A42B 1/046 2/205
2,086,325 A * 7/1937 Frankel ..... A41D 3/00 2/202
2,136,380 A * 11/1938 Garrison ..... A41D 3/00 2/84
2,170,339 A * 8/1939 Reeves ..... A41D 3/00 2/84
2,313,458 A * 3/1943 Tucker ..... A42B 1/045 2/84
2,507,322 A * 5/1950 Smith ..... A41D 3/00 D2/831
2,834,966 A * 5/1958 Zimmerman ..... A41D 27/18 2/84
3,359,567 A * 12/1967 Zemme ..... G21F 3/025 2/457
3,373,447 A * 3/1968 Kim ..... A42B 1/046 2/206
3,561,010 A * 2/1971 Little ..... A42B 1/045 2/173
3,676,879 A * 7/1972 Irie ..... A42B 1/045 2/202
3,717,882 A * 2/1973 Schuessler ..... A42B 1/046 2/202
4,038,698 A * 8/1977 Smith ..... A41D 3/06 2/79
4,272,853 A * 6/1981 Schuessler ..... A42B 1/0187 2/205
4,334,325 A * 6/1982 Walkuski ..... A41D 3/00 2/202
4,602,385 A * 7/1986 Warren ..... A41D 31/085 2/92
4,768,235 A * 9/1988 Webster ..... A41D 13/11 128/201.26
5,007,115 A * 4/1991 Denbow ..... A41D 23/00 2/202
5,339,466 A * 8/1994 McMullen ..... A41D 13/05 2/202

(Continued)

*Primary Examiner* — Heather Mangine
(74) *Attorney, Agent, or Firm* — Leason Ellis LLP

(57) ABSTRACT

The hooded piece of clothing enables the user to quickly convert the hood into a facial covering, by using an opening in the fabric, which can be quickly opened or closed by a fastener. The drawstrings on either side are pulled down to tighten the facial covering around the face.

4 Claims, 3 Drawing Sheets

(56) References Cited

Figure 1:
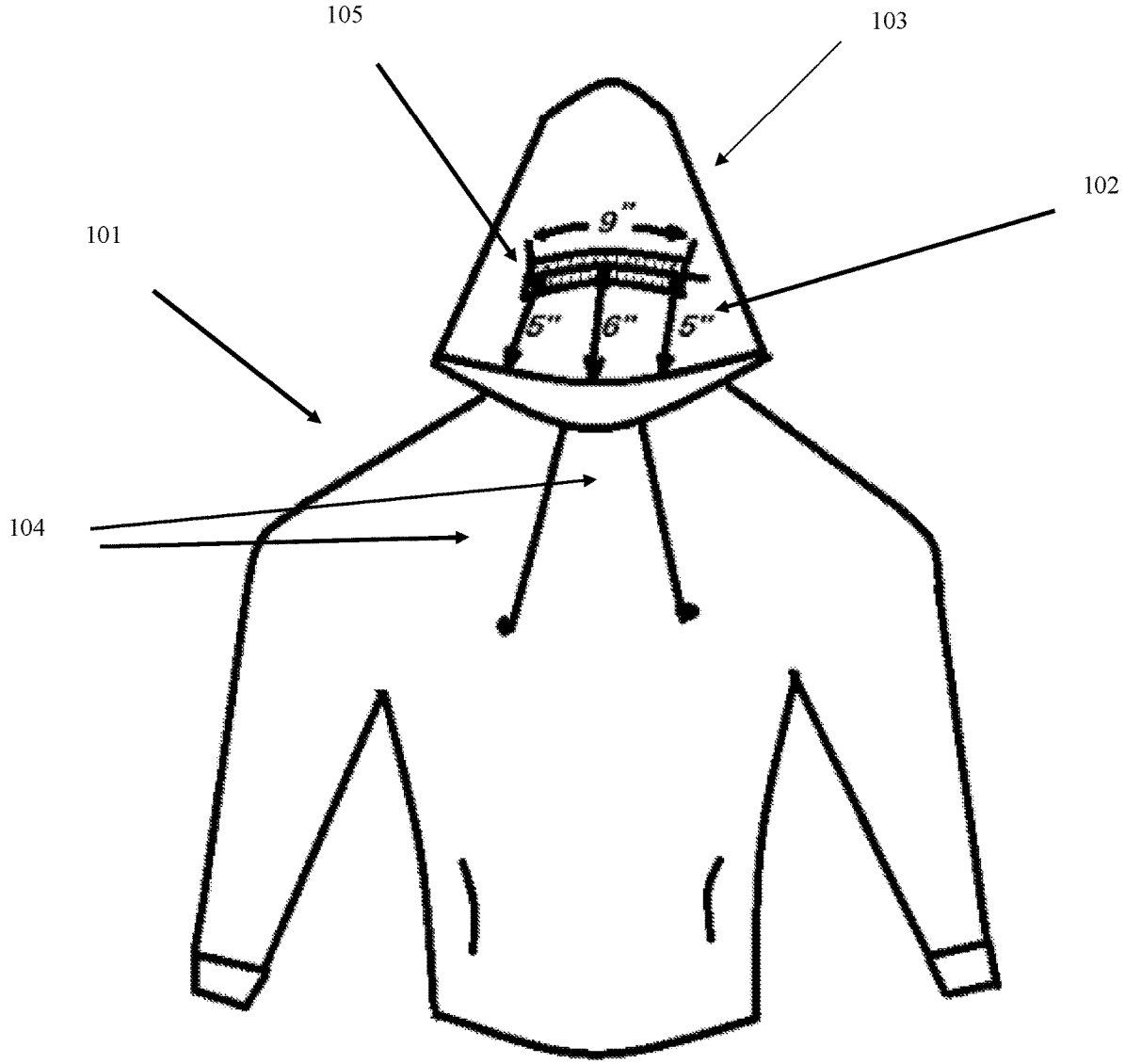

U.S. PATENT DOCUMENTS 5,511,249 A * 4/1996 Higgins ..... A42B 1/225 2/209.7
5,546,604 A * 8/1996 Geller ..... A42B 1/046 2/202
5,713,077 A * 2/1998 Humbrecht ..... A42B 1/045 2/173
5,822,800 A * 10/1998 Anderson ..... A42B 1/046 2/202
5,845,340 A * 12/1998 Frislie ..... A41D 13/1161 2/202
5,909,802 A * 6/1999 Puco ..... A42B 1/045 2/102
6,023,787 A * 2/2000 French ..... A41D 13/1153 2/173
6,374,418 B1 * 4/2002 Rindle ..... A42B 1/048 2/202
6,397,395 B1 * 6/2002 DeHart ..... A41D 3/005 2/173
6,665,878 B1 * 12/2003 Way ..... A41D 3/02 2/84
D512,204 S * 12/2005 Thomas ..... D2/831
D536,158 S * 2/2007 St-Germain ..... D2/831
7,418,740 B2 * 9/2008 Anderson ..... A41D 3/02 2/69
8,074,300 B1 * 12/2011 Molina ..... A42B 1/08 2/424
D662,284 S * 6/2012 Lam ..... D2/831
D685,160 S * 7/2013 Savage ..... D2/831
9,521,873 B1 * 12/2016 Mignone ..... A41D 13/1161
D849,330 S * 5/2019 Now ..... D29/108
D945,126 S * 3/2022 Butler ..... D2/891
2003/0135916 A1 * 7/2003 Hexels ..... A62B 17/00 2/457
2003/0154536 A1 * 8/2003 Anderson ..... A41D 3/02 2/108
2004/0098789 A1 * 5/2004 Carey ..... A42B 1/046 2/173
2005/0015850 A1 * 1/2005 Waldman ..... A41D 27/18 2/205
2008/0120762 A1 * 5/2008 Huang ..... A41D 13/1153 2/203
2008/0196146 A1 * 8/2008 Grilliot ..... A42B 1/046 2/202
2008/0216218 A1 * 9/2008 McKinney ..... A62B 17/006 2/457
2009/0055991 A1 * 3/2009 Johnson ..... A41D 1/04 2/84
2009/0151044 A1 * 6/2009 Shimshony ..... A42B 1/048 2/84
2009/0255030 A1 * 10/2009 Guy ..... A42B 1/225 2/84
2011/0185482 A1 * 8/2011 Godfrey ..... A41D 23/00 2/424
2011/0225699 A1 * 9/2011 Elhamsadat ..... A42B 1/048 2/84
2013/0160180 A1 * 6/2013 Carcich ..... A41D 31/0005 2/69
2014/0082826 A1 * 3/2014 Kuthari ..... A42B 1/02 2/171.7
2014/0096305 A1 * 4/2014 Friesen ..... A41D 1/04 2/84
2014/0237700 A1 * 8/2014 Albert ..... A41D 15/04 2/84
2014/0338092 A1 * 11/2014 Kinsey ..... A42B 1/048 2/84
2014/0352043 A1 * 12/2014 Harvey ..... A41D 13/001 2/456
2015/0026863 A1 * 1/2015 Elsmo ..... A47G 9/066 2/84
2015/0201681 A1 * 7/2015 Ron ..... A41D 19/0041 2/84
2015/0250240 A1 * 9/2015 Hunkele ..... A41D 15/04 2/86
2016/0015104 A1 * 1/2016 Edwards ..... A41D 27/20 2/94
2016/0309872 A1 * 10/2016 Domizi ..... A42B 1/225
2017/0055597 A1 * 3/2017 Lekven ..... A41D 13/1161
2017/0119076 A1 * 5/2017 Marji ..... A42B 1/048
2017/0216099 A1 * 8/2017 Saladino ..... A41D 3/005
2018/0042311 A1 * 2/2018 Carraro ..... A42B 1/048
2018/0132551 A1 * 5/2018 Holder, III ..... A41D 15/00
2018/0153141 A1 * 6/2018 Chapman ..... A42B 5/00
2018/0168258 A1 * 6/2018 Solle ..... A42B 1/006
2018/0271196 A1 * 9/2018 Hussey ..... A41D 13/012
2019/0000206 A1 * 1/2019 Domizi ..... A42B 1/12
2019/0125009 A1 * 5/2019 Meillassoux ..... B63C 11/04
2019/0289936 A1 * 9/2019 Hourani ..... A41D 13/0058
2020/0093195 A1 * 3/2020 Whitaker ..... A41D 27/201
2020/0154795 A1 * 5/2020 Valster ..... A41D 3/005
2020/0390179 A1 * 12/2020 Cherif ..... A45D 44/08
2021/0127773 A1 * 5/2021 Lowder ..... A41D 27/28
2021/0137197 A1 * 5/2021 Smith ..... A41D 3/005
2022/0117333 A1 * 4/2022 McCreesh ..... A42B 1/248

* cited by examiner

HOODIE MASK

CROSS REFERENCE TO RELATED APPLICATIONS

This application claims priority of and incorporates by reference U.S. provisional patent application No. 63/015,511, filed on Apr. 25, 2020.

BACKGROUND OF THE INVENTION

Facial coverings are known to prevent the transmission of airborne diseases, by preventing expelled infectious particles from coming into contact with other, non-infected individuals. Situations where facial coverings are required in public spaces, but not in private spaces are now common due to the ongoing COVID-19 pandemic, and as such, ensuring that one has a facial covering available to use at all times is important. Hooded clothes are commonly worn, and other hooded clothes are available with sewn-in or otherwise attached facial coverings. However, these facial coverings are often unable to be detached, removed, or stored in such a way that makes the mask easy to store away when not in use also readily available to be worn again.

BRIEF SUMMARY OF INVENTION

A hooded sweatshirt (101) with an integrated face mask (102) in the hood of the sweatshirt (103), which can be opened and closed, and which can be tightened around the face with drawstrings. (104)

BRIEF DESCRIPTION OF VIEWS

Figure 2:
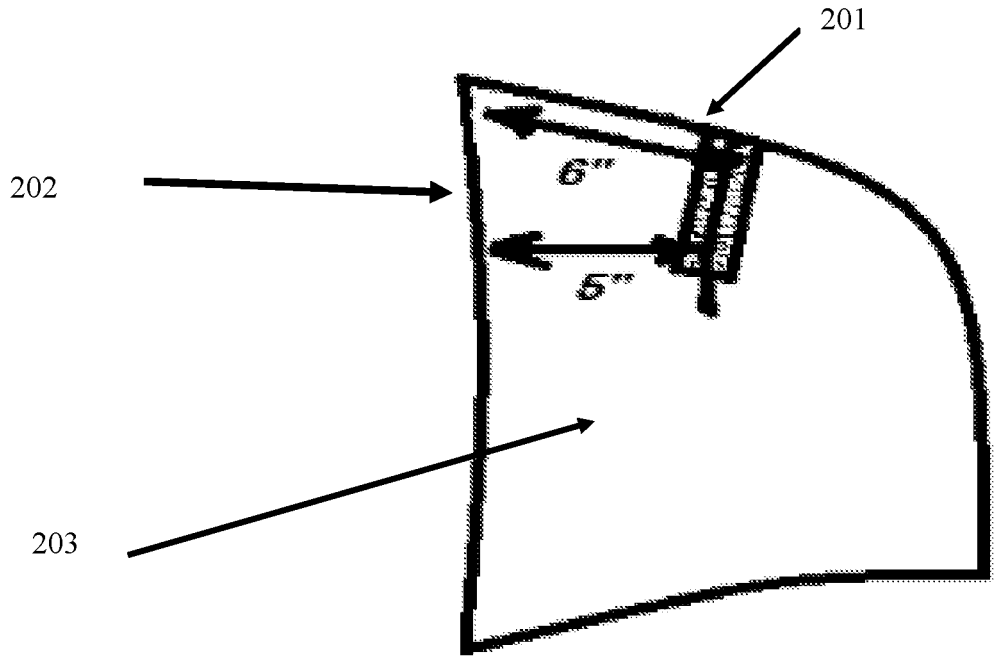
Figure 3:
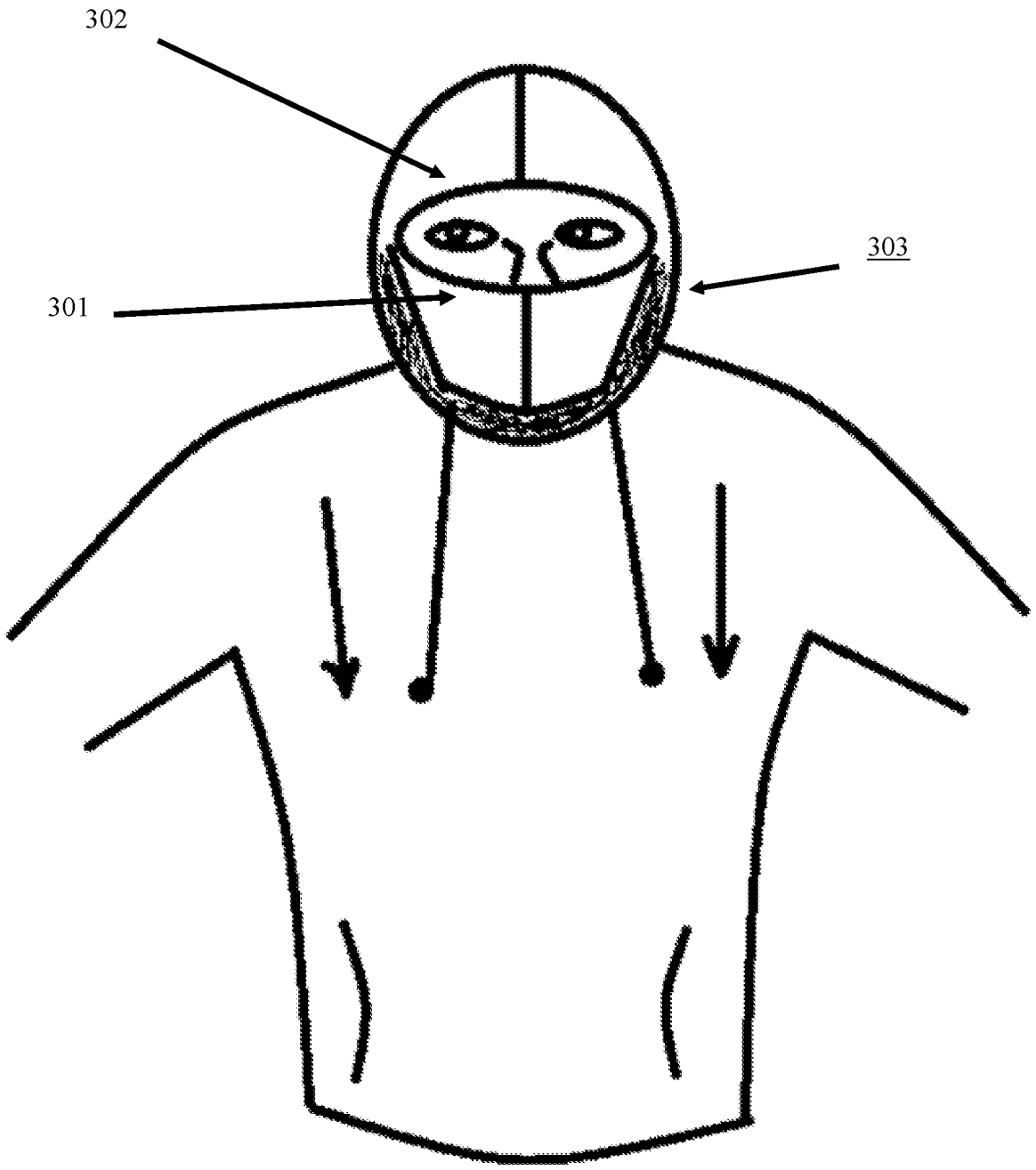

FIG. 1. depicts the closed position of the mask at the top of the hooded portion of the sweatshirt FIG. 2. depicts the side view of the close opening on the top of the hood FIG. 3. depicts the converting the hood into a mask by opening the closed portion of the hood, pulling the facial covering portion of the hood down around the nose and mouth, and adjusting the mask by pulling downwards on the drawstrings, such that the mask tightens around the face.

DETAILED DESCRIPTION OF INVENTION

A hooded piece of clothing (101) is comprised of clothing to be worn on the body, with a flap of fabric, the hood, (103) attached to the back portion of the neck opening which can be used to cover the head. The hoodie mask is a hooded piece of clothing where the hood section can be partially split, such that there is a hole in the hood. (105). The hole is original secured with a zipper, hook and loop fastener, buttons or some other fastener. (201) When the hole is open, if the hood is worn on the head, the face mask portion of the hood is comprised of the material at the front-most part of the hood, (102) (202) which can be pulled downwards in front of the face to cover the nose and mouth. The mask is then tightened around the nose and mouth with two drawstrings located near the chest and neck of the wearer (104).

The mask is tightened by pulling downwards on the drawstrings, which bunch the material on the outside edge of the hood, (203) including the edges of the face mask. The bottom edge of the hole (301) that was originally closed by the fastener is now located above the nose of the wearer, but below the eyes, and the top edge of the hole (302) is now located above the eyes of the wearer, such that the wearer is able to see through the hole. The mask can be loosened by loosening the material on the outer edge of the hood, (303) the hole can be re-fastened so that the hole is closed, and the hood can be worn as any other hooded piece of clothing. As seen in FIG. 2, the hole (105, 201) is closer to the front of the hood than to the back of the hood. The front of the hood is the portion of the hood that defines the face opening. The back of the hood is the portion of the hood that attaches to the rest of the hooded piece of clothing.

The invention claimed is:

1. A hooded piece of clothing comprising a hood and a body attached to the hood at a back edge of the hood, said hood comprised of a top portion comprised of an edge line that defines a face opening of the hood, said hooded piece of clothing comprising:

a hole opening in the top portion of the hood, where the hole opening is substantially horizontal in relation to the edge line of the top portion of the hood, said hole opening having a top edge and a bottom edge, said top and bottom edge in a first closed state fixed together by a fastener, and in a second open state, said top and bottom edge being unfixed, thereby permitting the top edge and bottom edge to separate and form the hole opening in the second open state;

a fabric region of the hood that is between the lower edge of the hole opening and the edge line of the top portion of the hood;

at least one drawstring attached to the fabric region of the hood, said at least one drawstring configured such that when said at least one drawstring is pulled when the fastener is in the second open state, the fabric region of the hood is repositioned to cover a nose and a mouth of a wearer of the hooded piece of clothing, while simultaneously leaving eyes of the wearer exposed through the hole opening; and said fastener further configured so that when the fastener is fixed together, the hole opening returns to the first closed state, where a distance from a center line defined by where the top edge of the hole opening and the bottom edge of the hole opening meet via the fastener in the closed state to the edge line of the top portion of the hood is between 5 inches and 6 inches, and where the hole opening is closer to the edge line in the top portion the hood than to where the hood is attached to the body at the back edge of the hood.

2. The hooded piece of clothing of claim 1 where said hole opening is about 9 inches long.

3. The hooded piece of clothing of claim 1 where the fastener is a zipper.

4. The hooded piece of clothing of claim 1 where the fastener is a hook and loop fastener.

* * * * *